United States Patent [19]

Kuranski et al.

[11] Patent Number: 5,000,199

[45] Date of Patent: Mar. 19, 1991

[54] ARRANGEMENT FOR APPLYING A FOAM-TYPE HAIR CARE LOTION

[75] Inventors: Andrea Kuranski, Frankfurt; Wolfgang Villmann, Rossdorf, both of Fed. Rep. of Germany

[73] Assignee: Wella Aktiengesellschaft, Darmstadt, Fed. Rep. of Germany

[21] Appl. No.: 944,439

[22] Filed: Dec. 18, 1986

[30] Foreign Application Priority Data

Dec. 18, 1986 [DE] Fed. Rep. of Germany ... 8535532[U]

[51] Int. Cl.[5] ..... A45D 24/22

[52] U.S. Cl. ..... 132/112; 132/212; 222/192; 401/190; 401/273

[58] Field of Search ..... 401/207, 290, 190, 272, 401/273; 132/112, 113, 114, 115, 116, 212; 222/402.21, 402.15, 192

[56] References Cited

U.S. PATENT DOCUMENTS

| | | | |
|---|---|---|---|
| 2,633,591 | 4/1953 | Servilla | 132/120 |
| 3,961,635 | 6/1976 | Miya | 132/113 |
| 4,044,724 | 8/1977 | Merchill | 132/112 |
| 4,533,273 | 8/1985 | Obata et al. | 401/190 |
| 4,557,619 | 12/1985 | DeVincentis | 132/112 |

*Primary Examiner*—Cary E. Stone
*Assistant Examiner*—Adriene B. Lepiane
*Attorney, Agent, or Firm*—Michael J. Striker

[57] ABSTRACT

An arrangement for applying a foam-type hair care medium, the arrangement having an element with a face having a central region and a plurality of projections extending from the face and spaced apart from each other, and a tubular body portion having at least one opening arranged substantially in the central region of the face of the element. The tubular body guides a foam-type hair care medium. The element with projections may be in the form of a brush with bristles or a comb with teeth. A foam dispenser formed as one piece on a disc member surrounded by a ring member may be added when mounted on an aerosol container containing the foam-type hair care medium to further guide the medium.

8 Claims, 1 Drawing Sheet

FIG. 1
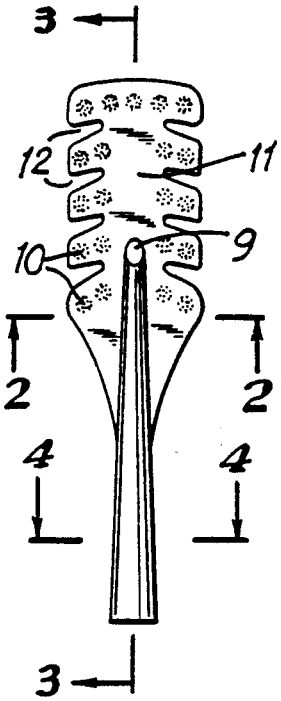
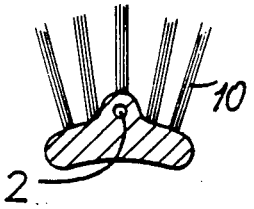
FIG. 2
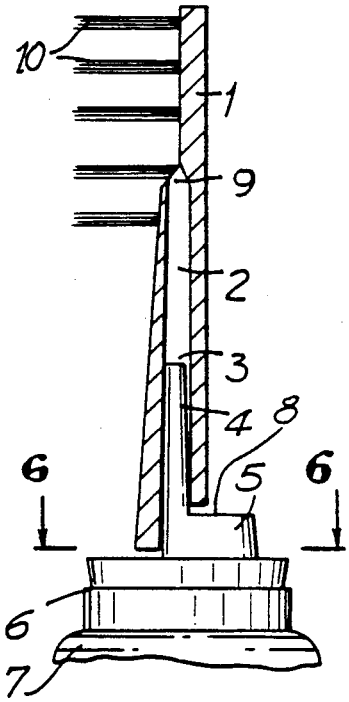
FIG. 3
FIG. 4
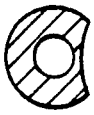
FIG. 5
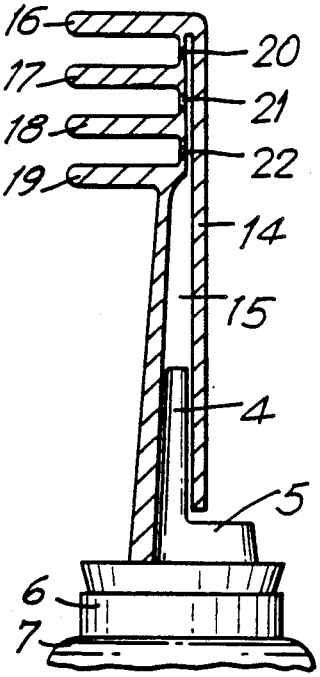
FIG. 6
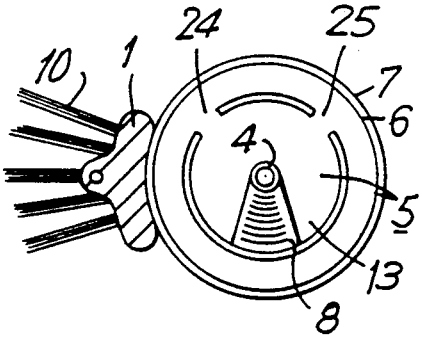

ARRANGEMENT FOR APPLYING A FOAM-TYPE HAIR CARE LOTION

BACKGROUND OF THE INVENTION

The present invention relates generally to an arrangement for applying a foam-type hair care lotion to hair. Such hair care lotions include hair tinting foams, hair setting lotions and hair treatment lotions. In practice, a person frequently applies a foam-type hair care lotion to hair with one hand managing and servicing an aerosol container and with the other hand spreading the hair care lotion on the hair or scalp. A glove is used to protect the hand spreading the hair care lotion. In short, this mode for applying foam-type hair care lotion is quite bothersome.

SUMMARY OF THE INVENTION

It is the object of the present invention to provide an arrangement for applying a foam-type hair care lotion in which a person can apply the same with one hand only, without coming into contact with the hair care lotion itself.

In keeping with this object, and others which will become apparent hereafter, one aspect of the invention resides, briefly stated, in an arrangement for applying a foam-type hair care medium, the arrangement having an element with a face having a central region and a plurality of projections extending from the face and spaced apart from each other, and a tubular body portion having at least one opening arranged substantially in the central region of the face of the element. The tubular body guides a foam-type hair care medium. The element with projections may be in the form of a brush with bristles or a comb with teeth.

It is another object to provide an arrangement for applying a hair care medium easily to individual hair parts, especially for tinting individual hair strands.

A foam dispenser may formed as one piece with a disc surrounded by and formed with a ring, in which the ring in engagable with an upper surface of an aerosol container containing a foam-type hair care medium to be guided.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a front plan view of a brush-type embodiment of the present invention.

FIG. 2 is a cross-section taken across section line 2—2 of FIG. 1.

FIG. 3 is a side elevational cross-section taken across section line 3—3 of FIG. 1 and further in position mounted on an aerosol container.

Elements which are the same in the drawings retain the same reference numerals.

DETAILED DESCRIPTION OF THE PREFERRED EMBODIMENT

Referring now to the drawings, FIGS. 1-3 show a brushtype embodiment of the present inventive arrangement in various plan and cross-sectional views.

The rear part 1 of the brush has a tube 2, which is conical in shape in a lower portion 3 in order to easily accomodate a discharge tube 4 of a foam dispenser 5. The foam dispenser 5, by the way of a ring shape 6, is mounted on the upper edges of aerosol container. As can be seen from FIG. 1, a step is formed between the discharge tube 4 and the remaining portion of the foam dispenser 5. The lower part of the tube 2, in turn, is provided with a step which corresponds to the step of the foam dispenser 5. In an assembled condition shown in FIG. 1, the discharge tube is inserted into the interior of the tube 2, and the steps of the tube 2 and foam dispenser 5 are brought in interengagement with one another so to provide a first retention of the brush on the foam dispenser and therefore on the aerosol container 7.

Through the application of a pressure by an actuating surface 8 of the foam dispenser 5, foam passes through the discharge tube 4 and tube 2 and its mouth 9, filling up a space between bristles 10 corresponding to the respective amount of foam administered. The foam between the bristles 10 can be spread on the hair using combing movements. In doing so, the foam discharging from the mouth 9 spreads as contact as possible to particular areas of the brush when, advantageously, a central area 11 of the brush is free of bristles 10. The mouth 9 communicates with this central area 11.

In another embodiment, the brush is formed as a skeleton brush in which the rear part 1 of the brush has a plurality of notches 12. The notches 12 are located in spaces between bristles 10. This arrangement makes it easier to dry one's hair, because the notches 12 simultaneously direct an air stream for drying, to which the brush is subjected.

As already illustrated in FIG. 2, in which the bristles 10 are turned away, the outer surface of the rear part 1 can have a concave curvature. A particularly advantageous arrangement results for commonly packaging the inventive arrangement and aerosol container when the curvature of this upper surface conforms to the curvature of the wall surface of the several aerosol container.

It will be understood that each of the elements described above, or two or more together, may also find a useful application in other types of arrangements for applying foam-type hair care lotions differing from the types described above.

While the invention has been illustrated and described as embodied in a foam-type hair care lotion, it is not intended to be limited to the details shown, since various modifications and structural changes may be made without departing in any way from the spirit of the present invention.

Without further analysis, the forgoing will so fully reveal the gist of the present invention that others can, by applying current knowledge, readily adapt it for the various applications without omitting features that, from the standpoint of prior art, fairly consititute essential characteristics of the generic or specific aspects of this invention.

What is claimed is new and desired to be protected by Letters Patent is set forth in the appended claims:

1. In combination an applicator for a foam-type hair care medium and a hair care medium container which has a foam dispenser provided with a discharge tube and a step formed between the discharge tube and a remaining portion of the foam dispenser, said applicator comprising an element including a face having a central region with at least one opening therein, a plurality of spaced apart projections extending from said face, and a rear portion defining a passage communicating with said at least one opening; and a tubular body for attachment to the hair care medium container and having a bore forming an extension of said passage for communicating hair care medium from the hair care medium container to said at least one opening, said tubular body having an end portion which is provided with a step formed in correspondence with the step of the foam dispenser, so that in an assembled condition the discharge tube is received in the interior of said tubular body and said step of said end portion of said tubular body engages with the step of the foam dispenser to provide a firm retention of the tubular body on the foam dispenser of the hair care medium container.

2. The combination as defined in claim 1, wherein said element is formed as a brush with said projections being formed as bristles.

3. The combination as defined in claim 2, wherein said face has a periphery surrounding said central region, said periphery having said projections extend therefrom.

4. The combination as defined in claim 3, wherein said tubular body is formed with a conically shaped inner surface.

5. The combination as defined in claim 1, wherein said element is formed as a skeleton brush.

6. The combination as defined in claim 1, wherein said face is formed with a plurality of adjacent notches extending inward toward said central region.

7. The combination as defined in claim 1, wherein said rear portion has a curvature, said curvature being formed to correspond with a curvature of a wall surface of the hair care medium container.

8. The combination as defined in claim 1, further comprising a foam dispenser element engageable with said tubular body.

* * * * *